US010413478B2

(12) United States Patent
Davis

(10) Patent No.: US 10,413,478 B2
(45) Date of Patent: Sep. 17, 2019

(54) SAFETY STATION TOOL

(71) Applicant: Aaron N. Davis, Placerville, CA (US)

(72) Inventor: Aaron N. Davis, Placerville, CA (US)

( * ) Notice: Subject to any disclaimer, the term of this patent is extended or adjusted under 35 U.S.C. 154(b) by 214 days.

(21) Appl. No.: 15/444,107

(22) Filed: Feb. 27, 2017

(65) Prior Publication Data

US 2018/0052020 A1 Feb. 22, 2018

Related U.S. Application Data

(60) Provisional application No. 62/378,205, filed on Aug. 22, 2016.

(51) Int. Cl.
*A61H 35/02* (2006.01)
*A47K 3/28* (2006.01)
*A61H 33/00* (2006.01)

(52) U.S. Cl.
CPC ..... *A61H 35/02* (2013.01); *A47K 3/286* (2013.01); *A61H 33/601* (2013.01)

(58) Field of Classification Search
CPC ..... G01F 1/00; A47K 3/286; A61H 35/02
USPC ..... 73/201
See application file for complete search history.

(56) References Cited

U.S. PATENT DOCUMENTS 4,245,666 A * 1/1981 Norris ..... E04D 13/00 137/357
4,784,184 A * 11/1988 Gates ..... E03C 1/086 138/109
5,172,718 A * 12/1992 Thornburgh ..... B67C 11/04 137/312
5,381,839 A * 1/1995 Dowd ..... B65B 3/30 141/237
6,845,784 B2 * 1/2005 Pasczuk ..... A62C 99/00 137/312
8,109,539 B2 * 2/2012 Krohn ..... F16L 17/00 285/322
2013/0021167 A1 * 1/2013 Harper, Jr. ..... G05B 9/02 340/870.01
2017/0135529 A1 * 5/2017 Joyer ..... A61H 35/00

OTHER PUBLICATIONS

"American National Standard for Emergency Eyewash and Shower Equipment", International Safety Equipment Association, Arlington, Virginia, ANSI/ISEA Z358.1-2014, pp. 1-22 (2015).
Cameron, Mark, "The Story on Emergency Eyewashes and Showers" pp. 1-5.

* cited by examiner

*Primary Examiner* — Marrit Eyassu
(74) *Attorney, Agent, or Firm* — David T. Millers

(57) ABSTRACT

A tool for use on safety showers may include a funnel, a drain system, a base, and a height adjustment mechanism. The funnel has an interior with a width wider than a showerhead of the safety shower, so that a showerhead may fit within or seal against the interior of the funnel. The drain system connected to conduct a flow from the funnel. The base supports the drain system and the funnel and may be placed on a floor beneath the showerhead, and the height adjustment mechanism may be coupled to control a height of the funnel and control sealing pressure that the funnel applies to a showerhead.

18 Claims, 5 Drawing Sheets

SAFETY STATION TOOL

CROSS-REFERENCE TO RELATED APPLICATIONS

This patent document claims benefit of the earlier filing date of U.S. provisional Pat. App. No. 62/378,205, filed Aug. 22, 2016, which is hereby incorporated by reference in its entirety.

BACKGROUND

Emergency safety showers and eyewash stations are important in many workplaces and particularly in workplaces that utilize corrosive chemicals. Safety showers, in general, are intended to provide a drenching flow of water that a user may stand in to quickly rinse away corrosive, toxic, or other dangerous substances to which the user may have been exposed. Eyewash stations produce flows of water with directions and rates suitable for flushing chemicals or irritants out of a user's eyes. Modern facilities in which handling of dangerous substances is anticipated often have emergency safety shower and eyewash stations that were part of the original facility design, but many emergency safety stations have been added to facilities as afterthoughts when a building was repurposed or when regulations were enacted after the original building construction. As a result, some emergency safety stations may not have been designed into or included with the original engineering of the buildings or structures that house the stations. In any case, some emergency safety stations may have improper installations or inadequate water supply or drainage that makes the stations difficult or unsafe to use or maintain. Safety stations may also be rarely used and may therefore be untested, neglected, or unmaintained for months or years, particularly because current testing methods may spray water on technicians and surroundings of the emergency safety station. All of these factors can lead to safety stations that fail to adequately perform in an emergency.

Some governmental agencies and industry groups have promulgated laws, regulations, and standards that set performance requirements or benchmarks for emergency safety shower and eyewash stations and require testing of such stations in an effort to ensure that the stations will operate properly and as expected when needed. These laws, regulations, and standards may particularly set forth performance parameters such as minimum and maximum shower heights, shower and eyewash water flow rates, and water quality and temperature requirements, but the inconvenience of current testing systems and techniques still inhibits full and frequent testing of safety shower and eyewash stations necessary for compliance with the relevant laws, regulations, and standards.

SUMMARY

In accordance with an aspect of the invention, a tool or a maintenance, testing, or certification method for use on an emergency safety station may provide an effective seal against or around a showerhead and thereby control fluid flow from the showerhead to avoid dousing a technician and splashing water in the environment surrounding the station being maintained or tested. The tool and method are suitable for single person use and avoid the need for a technician to employ a ladder or other additional equipment to access a showerhead. The tool may employ a modular construction that allows reconfiguration for different safety showers and for connection of an adapter that permits maintenance, testing, or certification of an eyewash station either separately from or simultaneously with operation on the safety shower. The modular construction and light-weight tool modules not only allow customization of the tool for specific jobs and different safety shower installations but also facilitates transport of the tool.

One specific embodiment is a tool for use on a safety shower. The tool may include a funnel, a drain system, a base, and a height adjustment mechanism. The funnel has an interior with a width wider than a showerhead of the safety shower, so that the perimeter of a showerhead may fit within and press or seal against the interior of the funnel. The drain system conducts a flow from the funnel. The base supports the drain system and the funnel and may be placed on a floor beneath the showerhead, and the height adjustment mechanism may be coupled to control a height of the funnel above the base and to press the funnel against the showerhead. More generally, the tool may be operated in either a vertical or horizontal configuration depending on the orientation of the showerhead.

Another specific embodiment is a method for maintaining, testing, or certification of a safety station. The method may include positioning the base of a tool beneath a showerhead of a safety station and adjusting a height of a tool so that an interior of a funnel at a top of the tool presses or seals against a perimeter of the showerhead. The funnel may thus capture a flow from the showerhead. In particular, when activating a flow from the safety shower, the flow may be confined in the funnel and may head through a drain system of the tool and out an outlet of the tool in a controlled manner without splashing a technician or the surroundings. While controlled, the flow through the drain system can be monitored. For example, a technician can view the clarity of the flow when flushing water from the showerhead, and the water flow rate and water characteristics such as temperature or clarity may be measured using sensors in the drain system. The sensors may further employ wireless communication to record measurements, for example, to document or certify that the safety shower performed up to the relevant standards, regulations, or laws.

BRIEF DESCRIPTION OF THE DRAWINGS

The drawings illustrate examples for the purpose of explanation and are not of the invention itself. Use of the same reference symbols in different figures indicates similar or identical items.

DETAILED DESCRIPTION

Shower tools such as disclosed herein may be used for testing safety showers, eyewash stations, and combination units for compliance with regulations or standards such as American National Standard for Emergency Eyewash and Shower Equipment standard ANSI/ISEA Z358.1-2014. The shower tools improve the safety of personnel working with or around corrosive chemicals as defined by the Occupational Safety and Health Administration (OSHA) by ensuring or allowing certification that emergency safety shower and eyewash stations are properly tested and maintained.

A tool for use on safety showers may include a funnel large enough to fit around the outside of a variety of shower heads commonly employed in safety shower installations. The funnel particularly has an inner diameter that may increase from a diameter of about 2 inches (5 cm), which is smaller than all or most showerheads used in safety showers, to a diameter of about 14 inches, which is larger than all or most showerheads used in safety showers. The inside of the funnel may press or seal against the perimeter of a shower head to efficiently capture water flow from the showerhead during maintenance, testing, or certification of the safety shower. In particular, the funnel may be made of a material, e.g., a plastic, that is strong enough to press against the showerhead but sufficiently compliant to form a seal around the perimeter of a showerhead. The shower tool may further include a lift or height adjustment system that allows the funnel to be set under a showerhead and then raised into contact with the showerhead. The shower tool may further include a drain system for water flow from the funnel to a facility drain or fluid capture system. The drain system may include one or more transparent sections that permit a technician to view the controlled water flow and particularly view the clarity of water flowing from the showerhead. The drain system may further include one or more measurement devices such as a flow meter to test or certify that the flow is safe and adequate or a thermometer to test or certify that the temperature of the water is in the desired range. More generally, the measurement devices may permit measurement of one or more characteristics of the water or the flows in safety stations. The tool may further include an attachment for an eyewash station that permits separate or simultaneous testing of a shower flow and eyewash flow at a safety station.

Figure 1:
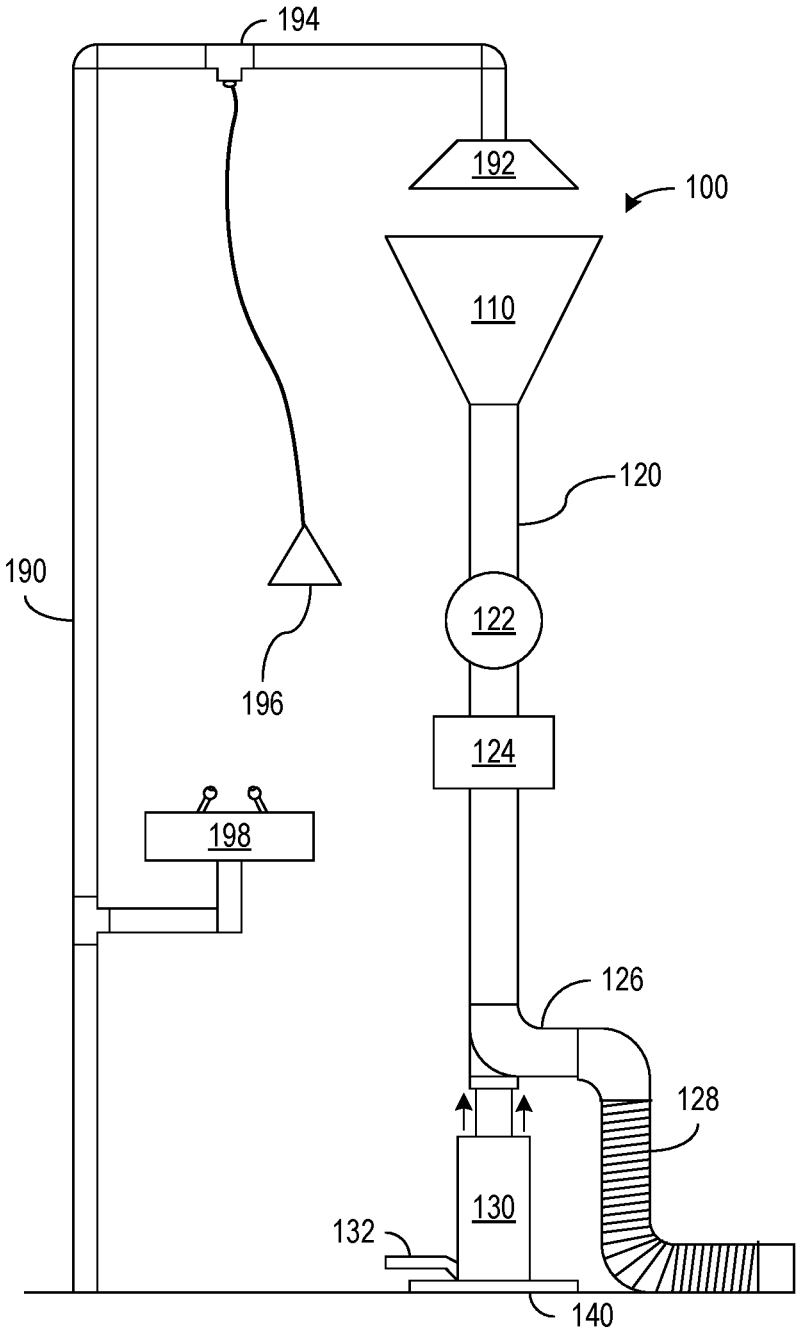
FIG. 1 illustrates an emergency safety shower and eyewash station and a tool in accordance with one implementation including a funnel sized and shaped to accommodate a variety of different showerheads and a height adjustment system at the base of the shower tool.

FIG. 1 shows an example of a tool 100 positioned for flushing or testing of a safety shower in a station 190, e.g., in an emergency safety station. Station 190 may particularly include a showerhead 192 and an eyewash station 198. In a typical installation in compliance with current safety station standards, showerhead 192 may be mounted at a height, e.g., 82 inches (208.3 cm) to 96 inches (243.8 cm) above the floor, so that a typical user may stand under showerhead 192. In an emergency, a user under showerhead 192 may begin a drenching flow of water by activating a valve 194, for example, by pulling on a cord, chain, or rigid lever 196 coupled to open valve 194. Valve 194 may particularly be a hands-free valve that is able to fully open within one second and that remains open until being manually closed. Once valve 194 is open a flow, e.g., 20 gallon per minute or more of water, flows through valve 194 and showerhead 192 until valve 194 is manually closed. The high flow through showerhead 192 and the need to manually close valve 194 may make safety station 190 inconvenient to flush or test with conventional tools.

Shower tool 100 includes a funnel 110 to catch water flowing from showerhead 192 and a drain system 120 that directs the water flow to a facilities drain or water capture system (not shown). Shower tool 100 has a height from a base 140 to a top of funnel 110 that is adjustable. FIG. 1 shows tool 100 adjusted to a height, e.g., 82 inches or less, where funnel 110 fits below showerhead 192. Shower tool 100 further includes a height adjustment system 130 that a technician may use to raise funnel into a working position. For example, height adjustment system 130 may lift funnel 110 from the height shown in FIG. 1 to a height shown in FIG. 2, where a perimeter of showerhead 192 is inside funnel 110. In some cases, the interior of funnel 110 is shaped, e.g., has a cone shaped inner wall or decreases in width or area, so that the perimeter of showerhead 192 can press (or even seal) against the inner surface of funnel 110 when funnel 110 is engaged with showerhead 192. More generally, funnel 110 may be shaped to be of sufficient diameter and size to fit around all or most showerheads while allowing for optimal flow to and through drain system 120. Further, funnel 110 may be made of or include a somewhat compliant material such as plastic or rubber to improve sealing around showerhead 192. As a result, funnel 110 can capture the entire water flow from showerhead 192 without letting water splash, leak, or overflow out of the top of funnel 110. Effective water capture in this manner allows the surroundings of station 190 and a technician operating shower tool 100 to remain dry. This may reduce the risk of water on the floor near station 190 and thus reduce the risk that the technician or others in the area may slip and fall. The ability of shower tool 100 to extend from base 140 on the floor to press the interior of funnel 110 against showerhead 192 also eliminates the need for a technician to stand on a ladder to reach showerhead 192.

Drain system 120 is in fluid communications with funnel 110 and includes a vertical section that conducts water from funnel 110 to an outlet or drainage port 126. More generally, other configurations of a tool may include multiple drainage ports. Each drainage port 126 may include a connector or fitting for connection of a hose or other device 128 that conducts water from station 190 to a facilities drain, e.g., building plumbing (not shown), or to a portable water capture container (not shown). Drain system 120 may further be plumbed to include additional fittings, inlets, or drainage ports (not shown), which may be configured for a particular emergency station 190 installation or an available drainage location. Drain system 120 may have any desired construction that is capable of handling the water flow from an emergency shower, and tool 100 may be constructed from different materials such as metal, plastic, or other waterproof materials. In one specific implementation, drain system 120 is constructed using PVC pipe and fittings about two inches in diameter. One or more section of drain system 120 may be transparent, e.g., clear PVC pipe, so that a technician can view and document the flow of water through drain system 120. A technician performing a maintenance operation such as flushing of station 190 may, for example, be able to turn on valve 194 and observe whether the water flow contains sediments or runs clean.

Drain system 120 may further be equipped to support instrumentation or monitoring equipment including one or more measuring devices 122 and 124, which may be used to measure one or more characteristics of the water or the water flow through drain system 120. For example, measuring device 122 may be a flow meter capable of measuring a flow rate, e.g., to determine whether the water flow meets regulatory requirements or established safety standards. Measuring device 124 may be a thermometer that measures water temperature to determine whether the water is within a required or desired temperature range. Some other types of sensors that may be employed in measuring device 122 or 124 may, for example, include conductivity or resistance sensors, turbidity or color sensors, pH sensors, and sensors for the presence or concentration of specific chemicals. Measuring devices 122 and 124 may, more generally, be selected as needed for safety shower certification and documentation purposes. In some implementation, measuring device 122 or 124 may include a communication interface, e.g., an interface implementing a wireless protocol such as the Bluetooth or Wi-Fi communication protocol, that permits communication with a computer system such as a laptop computer, a tablet, or a smart phone, and a technician may use a computer system to collect data from measuring device 122 or 124 to document performance of station 190.

Figure 2:
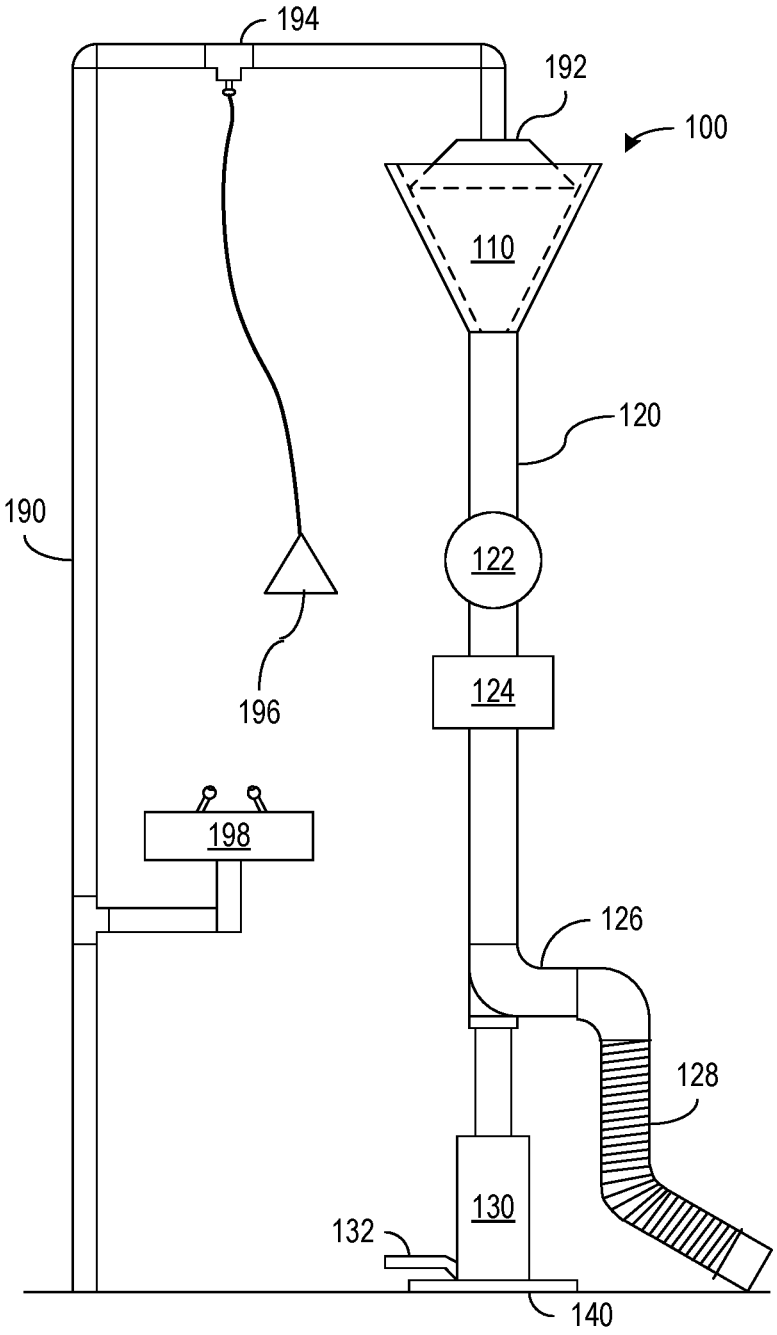
FIG. 2 illustrates the tool of FIG. 1 with the funnel in position to receive a fluid flow from a showerhead.

Height adjustment system 130 in the embodiment of FIGS. 1 and 2 is between base 140 and at least a portion of drain system 120. Base 140 may include a tripod or other configuration that accommodates an irregular floor surface and may include a joint or swivel that accommodates a sloped floor while keeping some components of funnel 110 directed for engagement with showerhead 192. Height adjustment system 130 being under drain system 120 also permits the components of drain system 120 may thus be securely fitted and fixed together, which may be less prone to leaks than in embodiments where a height adjustment system is part of a drain system. In general, height adjustment system 130 may be any device that is capable of expanding in height and holding the drain system 120 and funnel 110 in position to capture water flow from showerhead 192. Height adjustment system 130 may be any system capable of lifting or pressing funnel 110 into position. For example, height adjustment system 130 may include a mechanical or hydraulic jack, a winch or other cable mechanism operated by a crank or motor, or threaded links that change in length when turned manually or by a motor, although many such systems have lifting capabilities that exceed requirements of shower tool 100. In one specific implementation, height adjustment system 130 employs a hydraulic strut such as employed in chairs or stools. A hydraulic strut may, for example, provide a suitable range of height adjustment, e.g., more than 12 or 14 inches, and may provide a suitable vertical force to seal funnel 110 against showerhead 192 without damaging funnel 110 or station 190. Height adjustment system 130 in FIGS. 1 and 2 includes a foot pedal 132 that may allow a technician to activate or de-activate height adjustment system 130, while the technician guides funnel 110 toward or away from showerhead 192. Height adjustment system 130 more generally can be any system capable of supporting the section of drain system 120 being raised and capable of pressing funnel 110 against showerhead 192 without damaging funnel 110 or showerhead 192.

Figure 3:
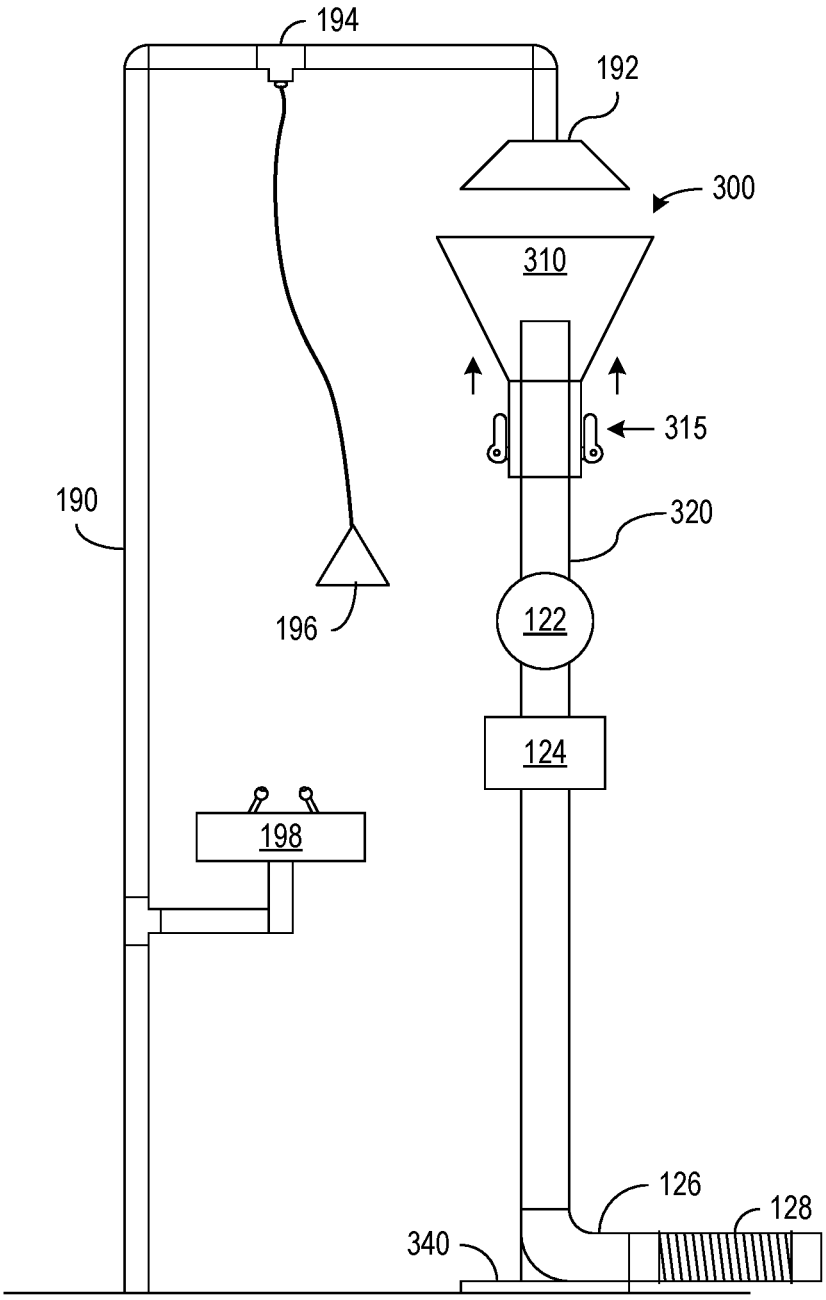
FIG. 3 illustrates an emergency safety shower and eyewash station and a tool in accordance with an implementation including a funnel with an alternative height adjustment system.

Instead of lifting a funnel from below and a drain system, a height adjustment system may include telescoping pipes, tubes, or bars that may be extended, e.g., pushed up directly by hand, with a mechanical crank system, or with an electrically powered drive, to the desired length. FIG. 3, for example, shows a shower tool 300 using an alternative height adjustment system that is not located at a base 340 of shower tool 300. In particular, shower tool 300 has a drain system 320 with an upper section including a funnel 310 capable of sliding up or down relative to a lower section of drain system 320. In particular, a telescoping coupling 315 may include an outer pipe that is free to slide on an inner pipe, and intervening seals may prevent water leakage between the inner and outer pipes. Telescoping coupling 315 permits the upper section of the drain system to be slid up until funnel 310 engages showerhead 192 as described above. At which point, the upper section may be locked in place, for example, using a compression fitting, a latch, or a cam-lock type connector, and the pressure between base 340 on the floor and funnel 310 in contact with showerhead 192 may keep shower tool 300 in position for flushing or testing water flow from showerhead 192. As described above, a technician can perform a maintenance operation to run water through showerhead 192 until the water supply for showerhead 192 is flushed clean. A technician may also use measuring devices 122 and 124 to measure one or more characteristics of the water or water flow. During either operation, a drain hose 128 can conduct the water flow safely away from the area.

Figure 4:
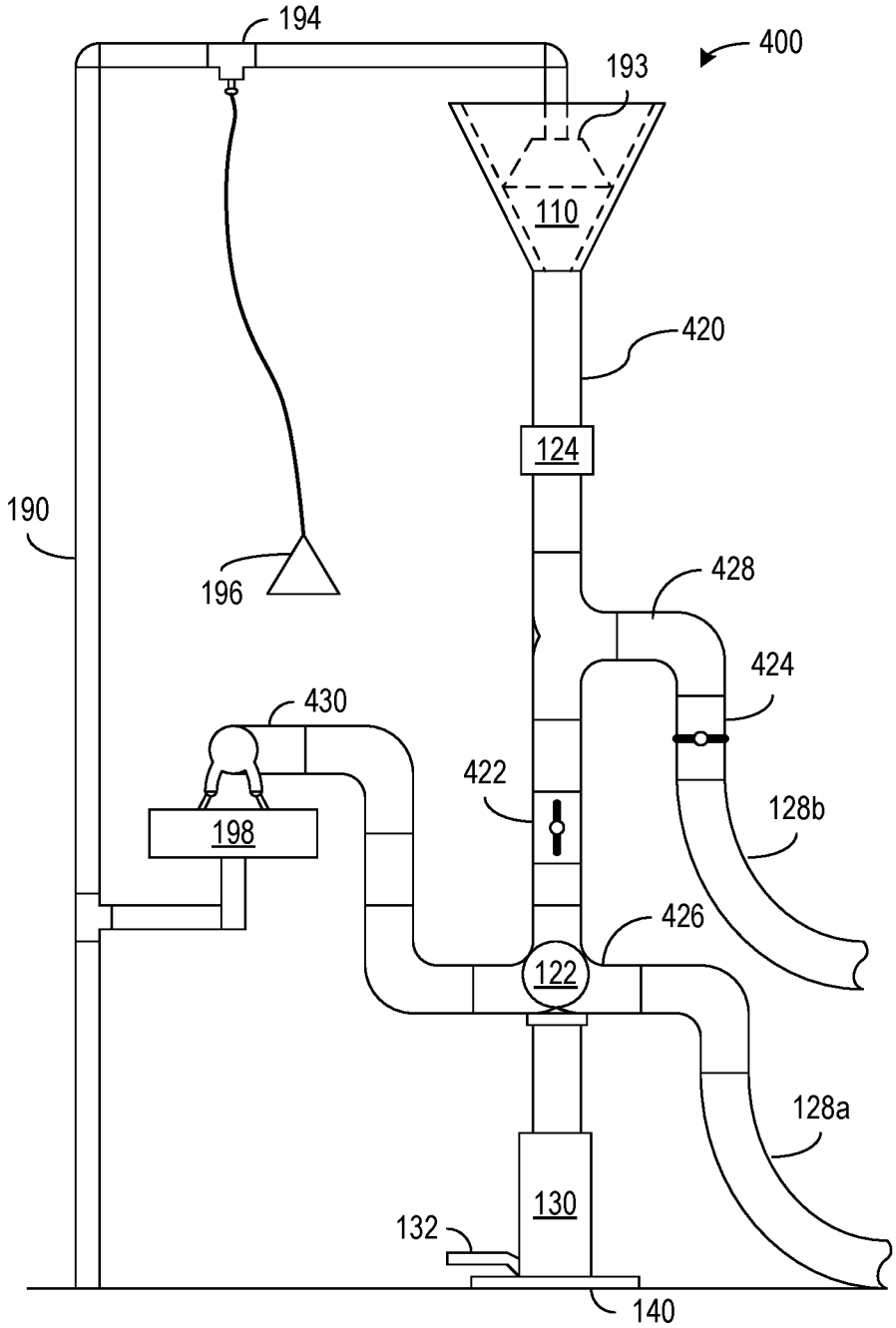
FIG. 4 illustrates an emergency safety shower and eyewash station and a tool configured for maintenance, testing, or certification of one or both of the shower and the eyewash.

Tools in some implementation may be able to test or maintain both emergency showers and eyewash stations. FIG. 4, for example, shows a tool 400 configured to capture water flow from a showerhead 193 and from an eyewash station 198. Tool 400 includes a funnel 110 on a drain system 420 and includes a height adjustment system 130 capable of pressing funnel 110 into contact with the perimeter of showerhead 193. FIG. 4 illustrates an installation of a safety station 190 employing a showerhead 193 that is smaller than showerhead 192 shown in FIGS. 1, 2, and 3. With a smaller showerhead 193, height adjustment system 130 may lift funnel 110 higher so that perimeter of showerhead 193 engages, presses, or seals against a portion of the interior of funnel 110 that is narrower than the portion of the interior of funnel 110 that showerhead 192 engages, presses, or seals against.

Drain system 420 differs from the drain systems described above in that drain system 420 is plumbed to include an eyewash adapter 430 that engages outlets of eyewash station 198. Current eyewash stations may employ a variety of different configurations, and the specific configuration of eyewash adapter 430 may be selected according to the specific configuration of eyewash station 198. In one implementation, eyewash adapter 430 includes flexible tubes or cups having ends or openings sized to stretch when fit onto outlets of eyewash station 198. The flexible tubes or cups may thus seal around the outlets of eyewash station 198 and direct water flows from eyewash station 198 through eyewash adapter 430 into drain system 420.

Drain system 420, as described above, has an inlet for water flow from a showerhead 193 and an inlet for water flow from eyewash station 198. Measuring devices 122 and 124 may be positioned in drain system 420 to measure the characteristics on a combined water flow from showerhead 193 and eyewash station 198 or measure each flow individually. As shown in FIG. 4, drain system 420 may particularly contain one or more valves 422 that may be used to control which flows are directed though a sensor 122. Valves 424 may also be used to control water flows out of multiple drainage ports 426 and 428, and one or more hoses **128*a* and 128*b* may be coupled to one or more of the drainage ports 426 and 428 to direct water to a drain or capture system. Tool 400 may thus be used to test only water from showerhead 192, only water from eyewash station 198, or a combined flow of water when both showerhead 192 and eyewash station 198** are in use.

One testing or certification method may involve testing a total of the simultaneous flows from showerhead 193 and eyewash station 198 and testing the flow from just eyewash station 198 while water is also flowing though showerhead 193. To test the total flow, valve 422 may be opened and valve 424 may be closed so that the captured flows from showerhead 193 and eyewash station 198 combine and flow through measuring device 122 and drain hose **128*a*. To test the flow from eyewash station 198, valve 422 may be closed and valve 424 may be opened so that the captured flows from showerhead 193 drains out through hose 128***b* and the flow from eyewash station 198 flows through measuring device 122 and drain hose 128*a*. Testing in this manner may be used to certify that the installation of safety station 190 provides adequate flow the eyewash station 430 even while showerhead 193 maintains a flow.

Figure 5:
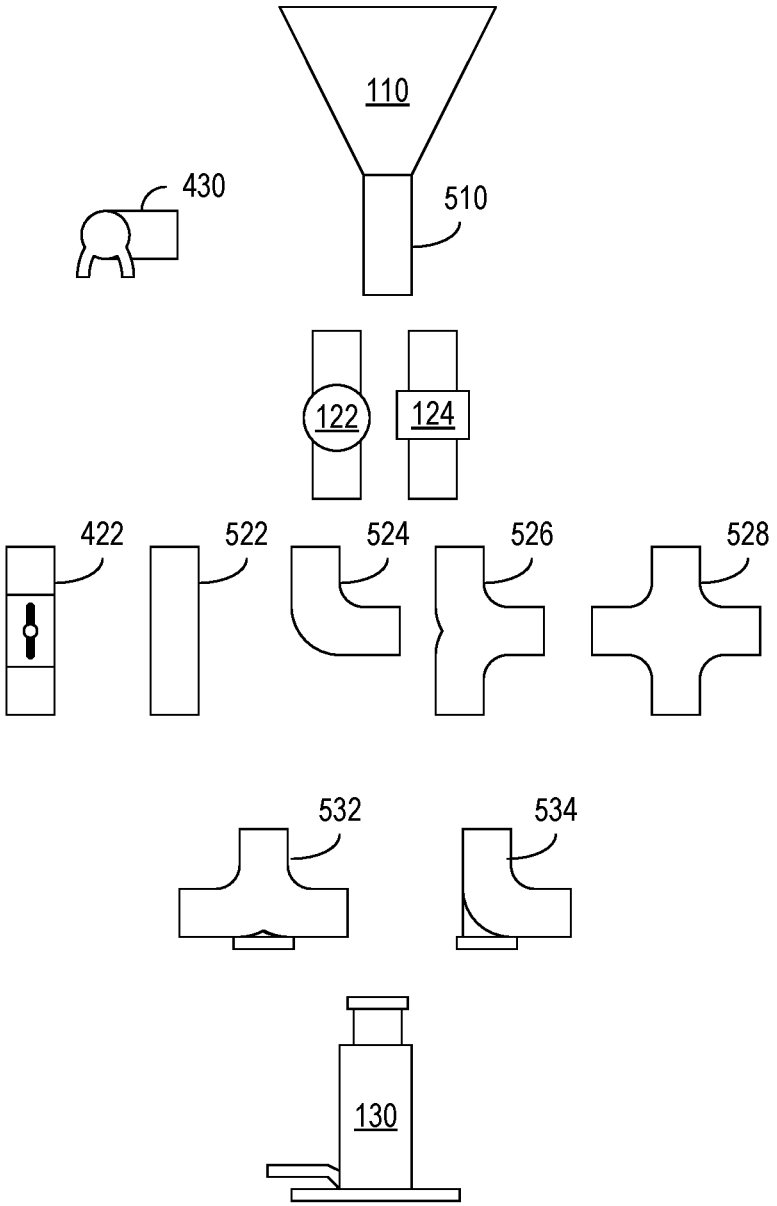
FIG. 5 illustrates modules that may be interconnected to customize a tool for different emergency station installations and different maintenance, testing, or certification tasks.

Shower tools 100, 300, and 400 being relatively tall may have components that are disassembled for transport and are reassembled as needed, for example, at the site of a safety station. In some implementations, a shower tool may includes pipes, valves, instruments with quick release connections, e.g., cam-lock connectors, for ease of assembly. Further, a modular construction may allow reconfiguration of a shower tool for different safety shower installations or for different maintenance, testing, or certification operations. FIG. 5 illustrates some typical modules that may be interconnected in many combinations for different emergency safety station configurations and many different testing or maintenance operations. The illustrated modules include a funnel section 510 including a funnel 110 for engaging a showerhead and an outlet connector for connection with other modules. Similarly, an eyewash adaptor 430 may include inlets adapted to seal onto the outlets of specific eyewash stations and an outlet for connection with other modules. Measurement devices 122 and 124 may be provided as modules with connectors for interconnection with other modules. Plumbing modules may include any convention plumbing elements suitable for connecting to each other and to modules 510, 430, 122, and 124. Plumbing modules may include valves 422, straight pipe lengths 522, elbows 524, tees 526, and cross fittings 528 to name a few examples, and the connectors on the plumbing modules may be adapted for connection to other modules or to other plumbing, e.g., hose connectors. The lengths of all of the modules may be chosen or set so that particular combinations or numbers of the modules provide the tool with the correct height for testing safety showers having heights in a standard range, e.g., a minimum height of about 82 inches or less to a maximum height of about 96 inches or more. The modules generally have fittings for interconnection with other modules but may also have a hose fitting or other connector for an external drain system. Any of the modules may further include an external or non-plumbing connector for mounting on a height adjustment module 130. Any or all of the modules may also include transparent sections or windows that permit viewing of water flows. When interconnected in the proper arrangement, a multi-module assembly may be adapted for a specific safety shower installation and for a specific operation being performed, e.g., for maintenance, testing, or certification of a safety shower or eyewash station. Even though the shower tools may be relatively tall, the shower tools can use light weight construction such as PVC pipes that permit the shower tool to be safely assembled and operated by a single person.

Although particular implementations have been disclosed, these implementations are only examples and should not be taken as limitations. Various adaptations and combinations of features of the implementations disclosed are within the scope of the following claims.

What is claimed is:

1. A tool for use on a safety station, the tool comprising:

a funnel, wherein the funnel is an open top funnel having inclined sidewalls;

a drain system connected to conduct a flow from the funnel;

a base supporting the drain system and the funnel; and a height adjustment mechanism coupled to control a height of the funnel above the base and to press an interior of the inclined sidewalls of the funnel against a showerhead of the safety station.

2. The tool of claim 1, wherein the interior of the funnel varies in width over a range including to a plurality of different widths respectively of different safety shower showerheads.

3. The tool of claim 2, wherein the range includes two inches to fourteen inches.

4. The tool of claim 1, wherein the drain system comprises a transparent portion providing a view of fluid flow through the drain system.

5. The tool of claim 1, wherein the drain system has an inlet coupled to the funnel and an outlet with a hose fitting.

6. The tool of claim 1, wherein the height adjustment system is between the base and the drain system.

7. The tool of claim 1, wherein the height adjustment system comprises telescoping pipes.

8. The tool of claim 1, wherein the height adjustment system supports a contact force of the funnel with the showerhead sufficient to seal the interior of the funnel against a perimeter of the showerhead.

9. The tool of claim 1, wherein the drain system further comprises a measurement device positioned to measure a characteristic of fluid in the drain system.

10. The tool of claim 9, wherein the measurement device comprises a sensor selected from a group consisting of a flow rate sensor, a temperature sensor, a conductivity sensor, a resistance sensor, a turbidity sensor, a color sensor, a pH sensor, and a sensor for presence or concentration of a specific chemical.

11. The tool of claim 9, wherein the measurement device comprises a wireless interface adapted to communicate measurement data from the measurement device.

12. The tool of claim 1, further comprising eyewash adapter having one or more inlets configured to couple to an eyewash station and an outlet coupled to the drain system.

13. A method comprising:

positioning a base of a tool beneath a showerhead of a safety shower;

adjusting a height of a tool so that inclined interior sidewalls of an open top funnel at a top of the tool presses against a perimeter of the showerhead;

activating a flow from the safety shower into the funnel and through a drain system of the tool to an outlet of the tool; and monitoring the flow through the drain system.

14. The method of claim 13, wherein monitoring the flow comprises flushing the flow from the showerhead until the flow becomes clear.

15. The method of claim 13, wherein monitoring the flow comprises measuring a flow rate of the flow.

16. The method of claim 13, wherein monitoring the flow comprises measuring a temperature of fluid in the flow.

17. The method of claim 13, further comprising:

coupling the drain system to receive a flow from an eyewash station;

configuring the drain system so that the flow from the safety shower is directed out of a first outlet of the drain system while the flow from the eyewash station is directed out of a second outlet of the drain system; and measuring the flow from the eyewash station while the flow from the safety shower is directed out of the first outlet.

18. The method of claim 17, further comprising:

configuring the drain system so that a combined flow including the flow from the safety shower and the flow from the eyewash station is directed out of one of the first and second outlets of the drain system; and measuring the combined flow.

* * * * *